United States Patent [19]

Maybrey et al.

[11] Patent Number: 5,014,534

[45] Date of Patent: May 14, 1991

[54] FRAME-MOUNTED ENTRY GUIDE SYSTEM

[75] Inventors: John G. Maybrey, Carlisle; George R. Harvey, Burlington, both of Canada

[73] Assignee: Stelco Inc., Ontario, Canada

[21] Appl. No.: 530,353

[22] Filed: May 30, 1990

[30] Foreign Application Priority Data

Jun. 20, 1989 [CA] Canada ..... 603373

[51] Int. Cl.[5] ..... B21B 39/16

[52] U.S. Cl. ..... 72/250; 72/227; 72/428

[58] Field of Search ..... 72/250, 251, 224, 227, 72/228, 428; 198/836; 226/196; 266/106

[56] References Cited

U.S. PATENT DOCUMENTS

| | | | |
|---|---|---|---|
| 3,283,554 | 11/1966 | Hermes et al. | 72/428 |
| 3,688,542 | 9/1972 | Platko | 72/428 |
| 3,798,952 | 3/1974 | Easter | 72/227 |
| 3,841,135 | 10/1974 | Natzke | 72/227 |
| 4,555,923 | 12/1985 | Reth et al. | 72/250 |

FOREIGN PATENT DOCUMENTS

| | | | |
|---|---|---|---|
| 0682521 | 10/1939 | Fed. Rep. of Germany | 72/250 |
| 0106420 | 7/1982 | Japan | 72/250 |
| 0212807 | 12/1983 | Japan | 72/250 |
| 0093535 | 12/1938 | Sweden | 72/250 |

*Primary Examiner*—Lowell A. Larson
*Assistant Examiner*—Thomas C. Schoeffler
*Attorney, Agent, or Firm*—Shoemaker and Mattare

[57] ABSTRACT

Guide devices are mounted on an apparatus which can be affixed to and supported by a frame such as an uplooper frame. The apparatus includes an entry guide mounted to the frame and supporting a slide bar with a horizontal top edge extending parallel with but displaced from the pass line. A guide box carriage is movably secured to the slide bar and a guide box is supported by the guide box carriage. A bell mouth carriage is also removably secured to the slide bar between the guide box carriage and the frame, with the bell mouth assembly being manually and removably secured to the bell mouth carriage. All major portions can be removed or put into place quickly with the aid of an overhead crane.

8 Claims, 8 Drawing Sheets

FRAME-MOUNTED ENTRY GUIDE SYSTEM

This invention relates generally to the steel making industry, and has to do particularly with a novel construction for entry roller guides which may be of the kind typically located between an uplooper and a stand of mill rolls, in a processing line which converts billets into rod and bar stock. It will be recognized from what follows that the novel construction disclosed could well be utilized in other, similar processes, and is not limited to the particular application described below.

BACKGROUND OF THE INVENTION

It is well known to process billets into smaller-diameter rod or bar stock by first heating the billet (typically having a square cross-section between 4" and 7" on a side), then passing the billet through a series of rollstands in order to form and reduce its cross-section. For example, in a typical process it may require 18 rollstands to reduce a 6" by 6" billet down to a rod of ⅝" diameter.

In such conventional processing lines, it is known to provide an uplooper which allows the in-process product (originally the billet) to loop away from the nominal pass line so that various roll speeds can be coordinated. The invention disclosed herein is described as being mounted on part of an uplooper frame, but it will be understood that other kinds of frames could also be utilized.

Between the downstream end of a typical uplooper and the next stand of mill rolls, provision must be made to keep the in-process product entering the roll pass at the exact and optimum position. By way of explanation, it is common to utilize mill rolls having a series of circumferential grooves which are separated axially along the rolls. The operator chooses from among them by adjusting the longitudinal position of the rolls with respect to the pass line.

The conventional structure for guiding a product along the pass line involves large and cumbersome entry guide boxes, typically mounted on the housing for the mill rolls into which the product is to be directed. These large structures are difficult and hazardous to install and adjust, and require lengthy mill delays to pass change or remount.

GENERAL DESCRIPTION OF THIS INVENTION

In view of the problems described above for the conventional large entry guide boxes, it is an object of one aspect of this invention to provide a guide mounting assembly of novel construction, which can be mounted to a frame (such as an uplooper frame) rather than to the mill roll housing.

An object of a further aspect of this invention is to provide a guide mounting arrangement consisting of several units that can be easily and quickly removed and put in place by the use of an overhead crane.

The arrangement to be described hereinafter offers a number of important advantages. Firstly, pass changes can be made without unclamping entry guides. The rollstand is simply raised or lowered to present a new pass to the entering product. In a preferred embodiment, guide box adjustments can be made with product in the mill, and without loosening the guide box clamping.

With the design of the present invention, the north-/south location of the guide box can be automatically determined by providing a stop block on the main frame. Micro-adjustment in the north/south direction is possible.

This design further offers completely unobstructed access to the roller guides for adjustment and inspection.

This design is such that when the entry guides are dropped into place, they are automatically located at the correct pass line.

Pass changes that conventionally require 40 to 45 minutes can typically be accomplished in five minutes.

This design safely handles the guide box, thus reducing safety hazards and the associated problems involved with installation and adjustment.

In a preferred version of this design, the location of the entry boxes would be adjustable in the east/west direction.

More particularly, this invention provides, in a hot rolling assembly for rolling a metal billet into a desired cross-section, the assembly including a plurality of roll stands and a frame means upstream of one of the roll stands, the improvement which comprises:

an entry guide mounting assembly removably mounted to the frame means between the latter and said one of the roll stands, a slide bar fixed to and supported by the entry guide mounting assembly, the slide bar extending substantially parallel with the pass line but spaced laterally therefrom, a guide box carriage removably secured to said slide bar, a guide box supported by said guide box carriage, the guide box being on the pass line, a bell mouth carriage removably secured to said slide bar between the guide box carriage and the frame means, and a bell mouth assembly removably secured to said bell mouth carriage, the bell mouth assembly being on the pass line, the slide bar being a vertically oriented plate with a horizontal upper edge defining substantially a point in cross-section, and a horizontal bottom edge, each said carriage having a pointed groove complementary with said point, and also having gripping means for securely gripping the bottom of the said slide bar so as to firmly mount the respective carriage to the slide bar.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 4:
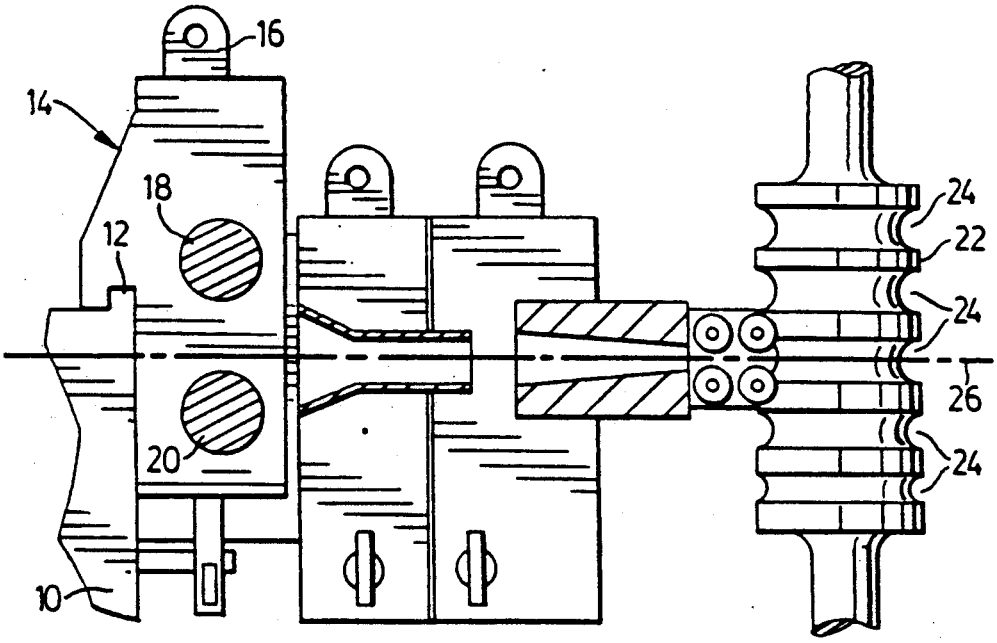
FIG. 4 is a further schematic elevational view, showing the third component assembled and in place.

Attention is first directed to FIG. 4, which shows schematically the furthest downstream portion of a frame 10 (which may be an uplooper frame) upon which an entry guide mounting assembly 14 can be mounted. The assembly 14 shown in FIG. 4 includes a lifting lug 16, and contains two freely turning rollers 18 and 20. Both of the rollers 18 and 20 rotate about horizontal axes, the lower roller 20 being fixed in position, the upper roller 18 being capable of vertical adjustment.

Also shown in FIG. 4 is one of a pair of vertical mill rolls 22, the mill rolls being mounted for rotation about vertical axes, and having a plurality of longitudinally spaced peripheral grooves 24. Vertical adjustment of the mill rolls makes it possible to present different ones of the grooves 24 to the pass line, the latter being shown at 26 in FIG. 4.

Figure 1:
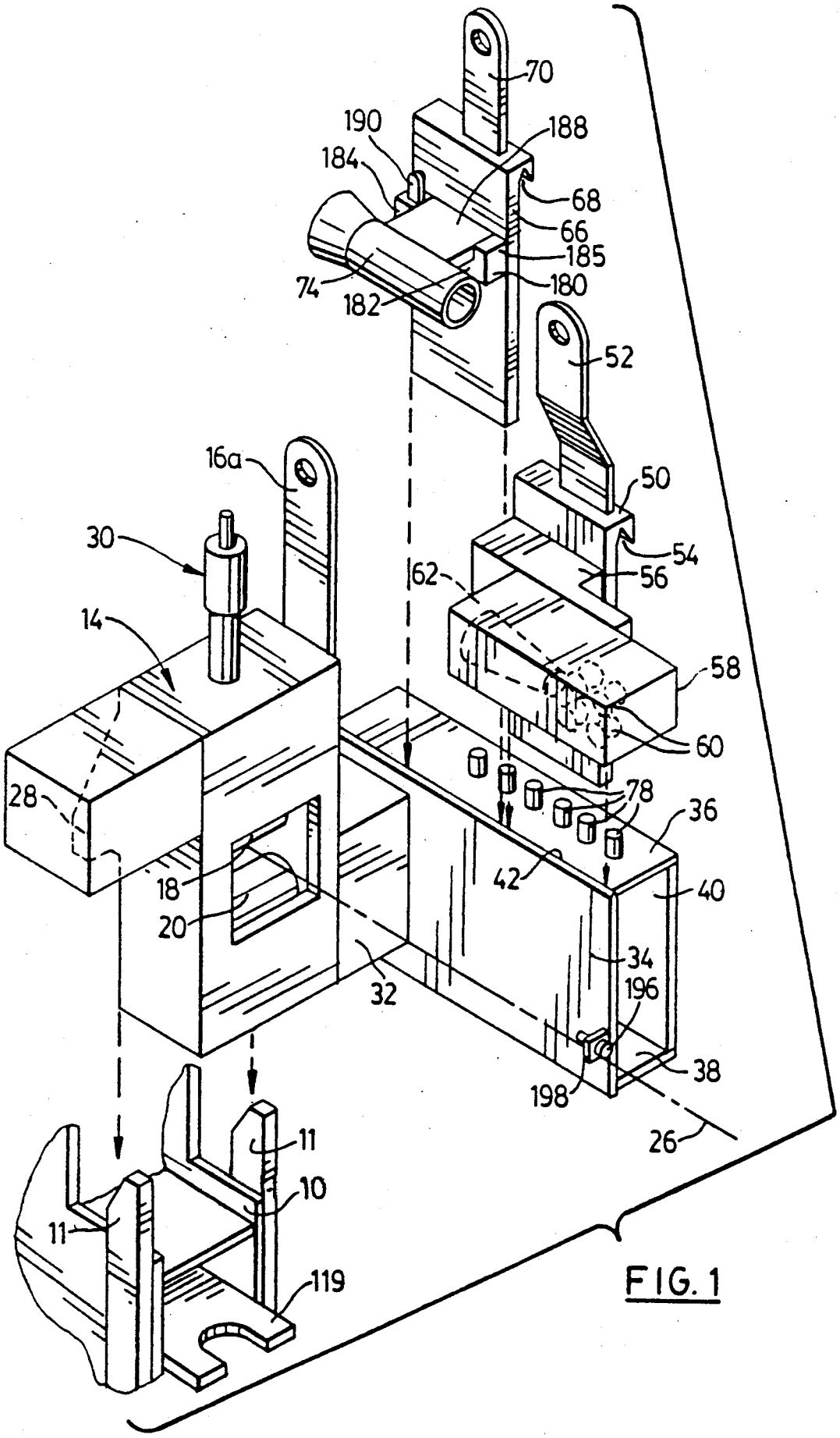
FIG. 1 is an isometric schematic view of the various components of this invention, in an exploded arrangement.

Attention is now directed to FIG. 1, in which the assembly 14 is illustrated with its basic parts, the assembly 14 being shown directly vertically above its ultimate position when mounted to the frame 10. As seen in all of FIGS. 1-4, the assembly 14 includes two hook brackets 28 intended to hook over upstanding portions 11 of the uplooper frame 10. In FIG. 1, the numeral 30 designates an adjustment mechanism by which the vertical position of the upper guide roller 18 can be changed.

The assembly 14 is shown in FIG. 1 as a basic rectangular box, although those skilled in the art will understand that is can be constructed in various different shapes. In FIG. 1, the assembly 14 is shown to include a bridging portion 32 extending rightwardly, the bridging portion supporting a slide bar 34 which is stiffened by two plates 36, 38 which are joined by a third plate 40. As can be seen in FIG. 1, the slide bar 34 converges at the top to a pointed edge 42, which projects upwardly beyond both the bridging portion 32 and the plate 36 (also seen in FIG. 7).

Turning again to FIG. 1, attention is now directed to the illustration of a guide box carriage 50 having an offset lifting bracket 52, and defining an upwardly projecting V-shaped groove 54 adapted to seat against the pointed edge 42 of the slide bar 34. As can be seen in both FIGS. 1 and 8, the guide box carriage 50 is essentially a vertical, rectangular plate.

By modalities not illustrated in FIG. 1, a cross-adjusting base 56 is clamped to the guide box carriage 50 in such a way that it can be vertically adjusted, without loosening any clamps. Mounted in turn on the cross-adjusting base is a guide box 58 containing guide rolls 60 at the downstream end, and containing a funnel guide 62 at the upstream end. The guide box 58 is mounted to the cross-adjusting base in such a way that it can be vertically adjusted. Also, the entire guide box carriage 50, along with the guide box 58, can be adjusted toward and away from the pass rolls, by a mechanism later to be described.

FIG. 1 also illustrates a bell mouth mounting plate 66, having a construction similar to that of the guide box carriage 50. Essentially the mounting plate 66 is a rectangular, vertically oriented plate of steel, defining at the top an inverted V-shaped groove 68 by which it can hook over and engage the upper edge 42 of the slide bar 34, in a position immediately upstream of the guide box carriage 50.

The mounting plate 66 has a lifting bracket 70, and means for supporting a bell mouth 74 in such a way that the bell mouth is automatically positioned on the mill pass line.

Sufficient detail has been explained to allow a description of the procedure by which the various components shown in FIG. 1 are put in place.

Figure 2:
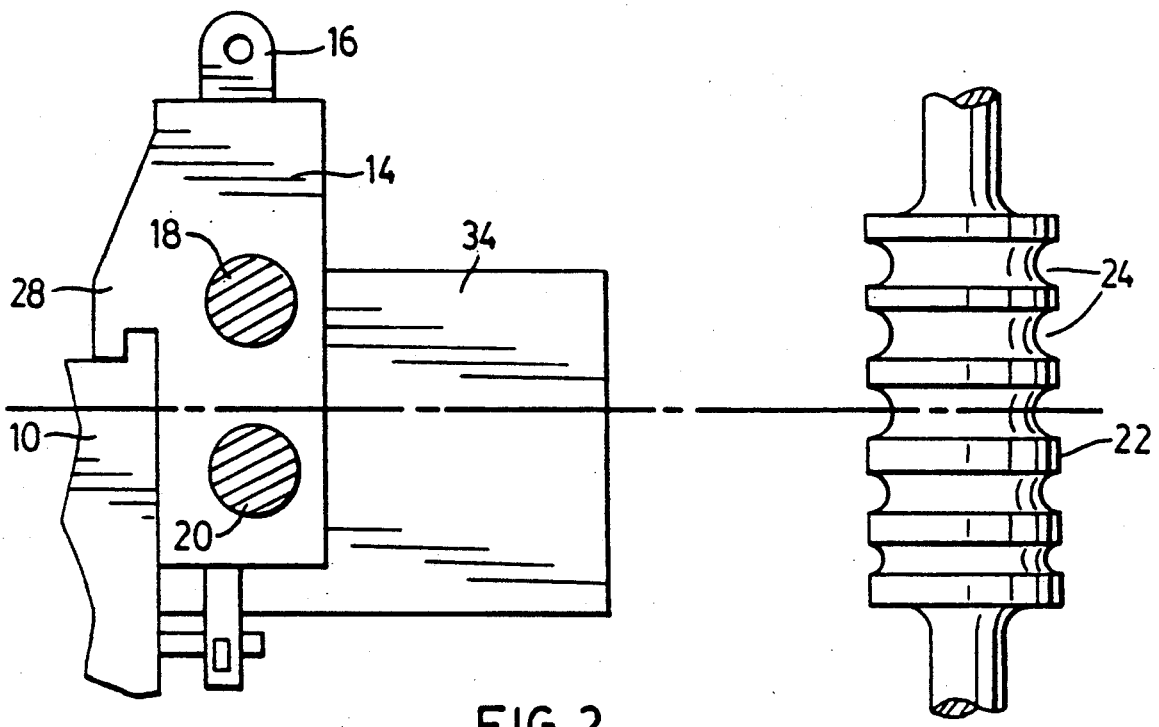
FIG. 2 is a schematic elevational view showing the installation of one component of the entry guide arrangement of this invention.
Figure 3:
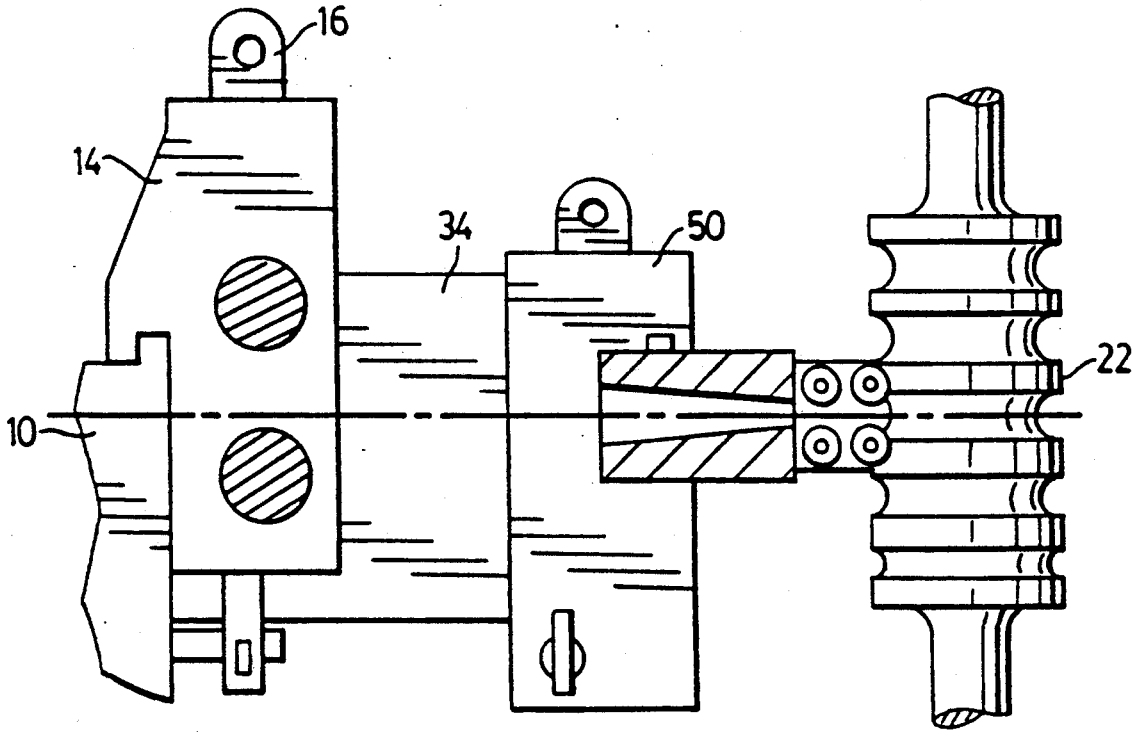
FIG. 3 is a view similar to that of FIG. 2, showing the second component in place.

Firstly, the guide mounting assembly 14 is engaged over upward projections 11 of the frame 10, utilizing the bracket hooks 28. The result of this first step is illustrated in FIG. 2

Next, the guide box carriage 50, with the base 56 and guide box 58 in place, is dropped onto the slide bar 34. In a typical construction, the mill rolls are contained within a mill roll housing which projects toward the frame 10, thus not permitting the carriage 50 to be simply dropped into its final position. Instead, the carriage 50 is dropped onto the slide bar 34 adjacent the assembly 14 (i.e. in the furthest upstream position), and then is manually shifted toward the mill rolls using a pry bar and permanent pins 78 affixed to the plate 36 (see FIG. 1). When the carriage 50 achieves its final position, it can be locked into place by a wedge arrangement (not shown in FIG. 1).

Next, the bell mouth mounting plate 66, without the bell mouth 74, is dropped into place immediately upstream (to the left in FIG. 1) of the guide box carriage 50, resulting in the situation shown in FIG. 4. The mounting plate 66 is locked in place by means of a wedge arrangement (later to be described).

Finally, the bell mouth 74 is manually put into place against the bell mouth mounting plate 66, after visual alignment of the assembly.

Description in greater detail will now be given for the various components of this invention.

Figure 5:
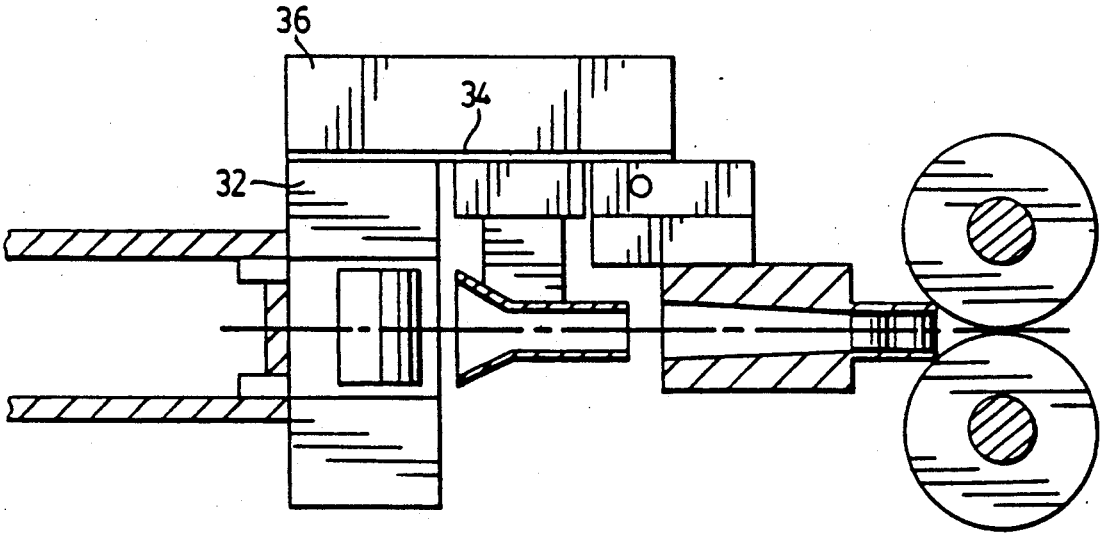
FIG. 5 is a plan view of the arrangement shown in FIG. 4.
Figure 5A:
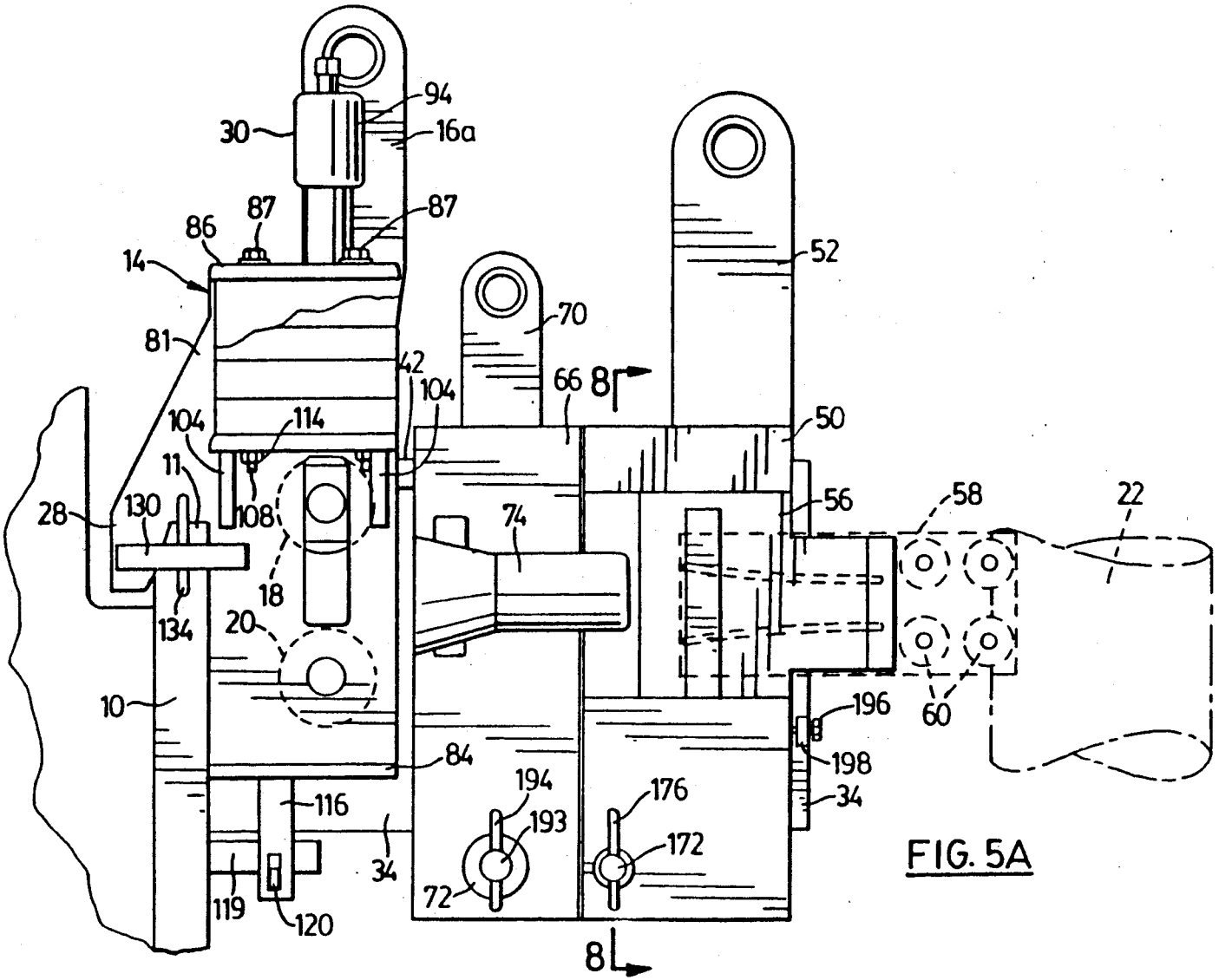
FIG. 5A is a view similar to FIG. 4, showing more detailed outlines of the various components.
Figure 6:
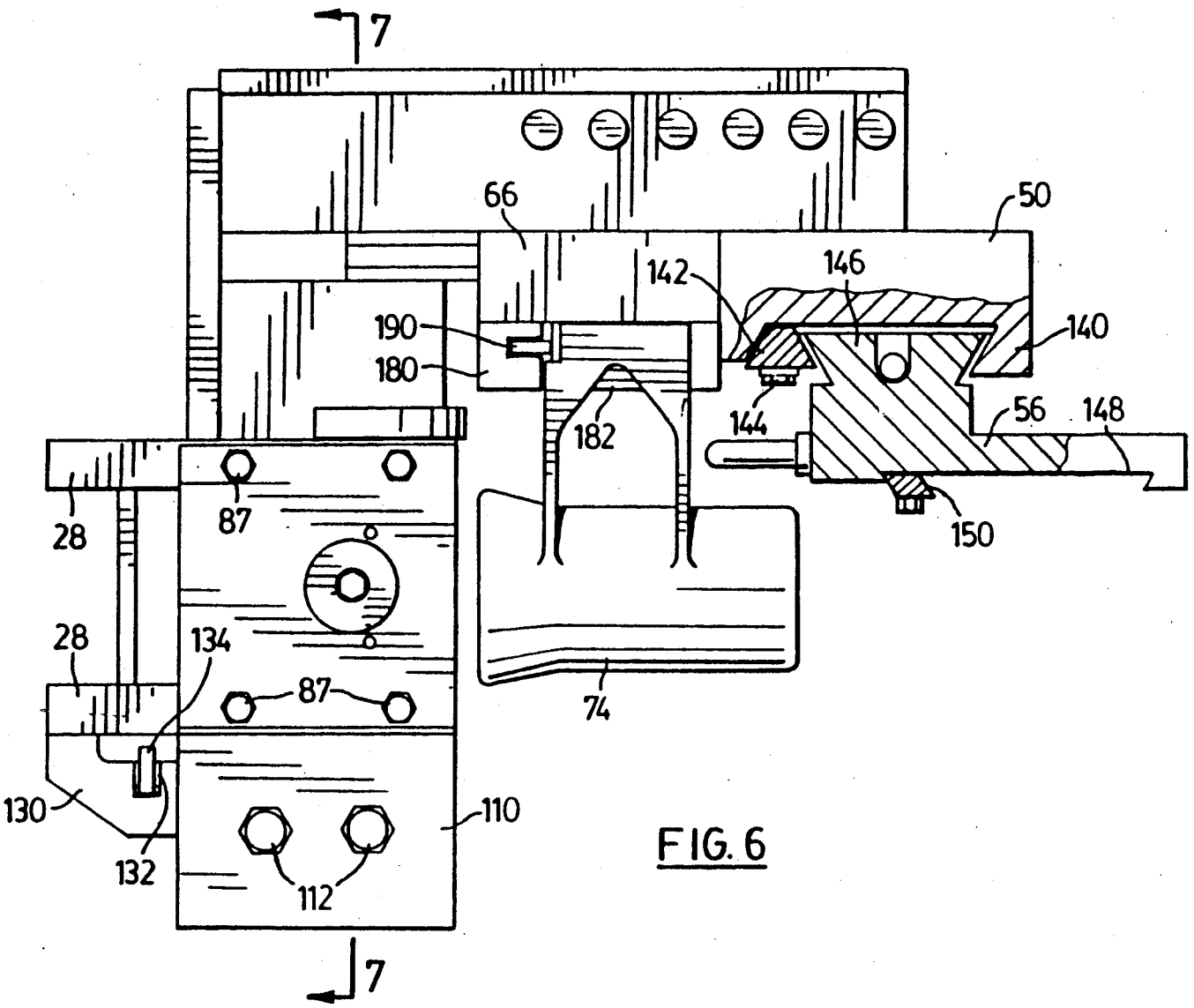
FIG. 6 is a plan view of the arrangement shown in FIG. 5A.
Figure 7:
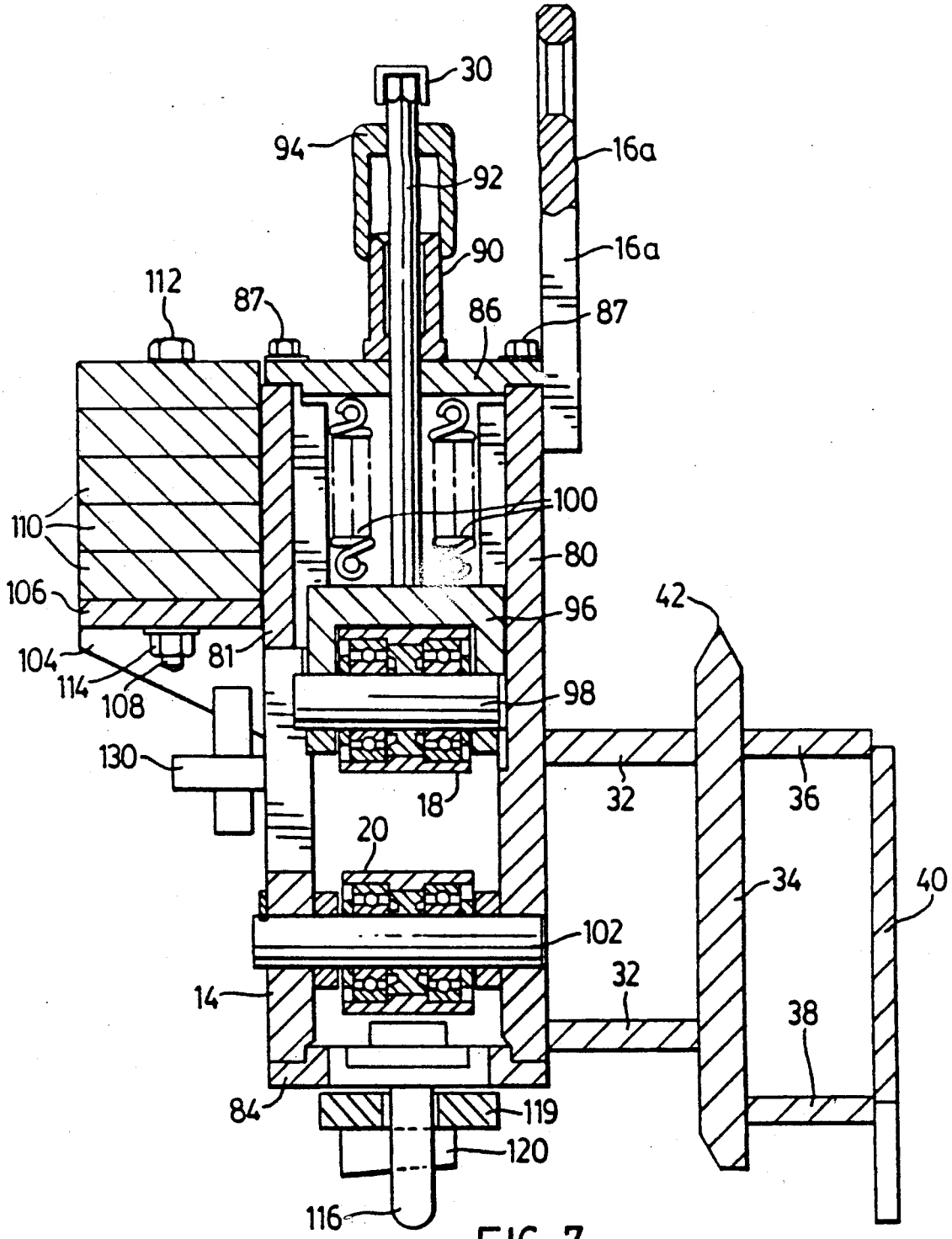
FIG. 7 is a vertical sectional view taken at the line 7—7 in FIG. 6.

Attention is directed first to FIGS. 5A, 6 and 7, from which it can be seen that the assembly 14 incorporates two vertical rectangular plates 80 and 81, which are spaced apart and which lie in planes parallel with the pass line direction. The plates 80 and 81 are rigidly connected together at the bottom by a welded bottom plate 84, and are connected at the top by welded vertical plates (not seen in FIG. 7) which span between the plates 80 and 81 adjacent their upper ends. Illustrated in FIG. 7 is a removable top plate 86, which is attached by fasteners 87. Welded to the top plate 86 is a centrally located, upstanding sleeve 90 through which passes a threaded shaft 92. A protective sleeve 94 is welded to the threaded shaft 92, and telescopingly engages the sleeve 90. The top plate 86 has a threaded bore through which the shaft 92 passes, so that when the upwardly projecting end of the shaft 92 is rotated, as by a ratchet arm, the shaft 92 moves vertically with respect to the top plate 86.

A chock 96 supports a shaft 98 about which the roller 18 is freely rotatable. The chock 96 is drawn upwardly by springs 100, in such a manner that the vertical position of the threaded shaft 92 determines the location of the chock 96. To cause the chock 96 to move upwardly or downwardly, the threaded shaft 92 is rotated in the appropriate direction.

A further shaft 102 is mounted between the plates 80 and 81 at the lower portion thereof, and supports the roller 20 for free rotation.

As can be seen in FIG. 7, the lifting bracket 16a is welded at the upper portion of the plate 80.

Two brackets 104 are welded to the plate 81 and project perpendicularly thereto, supporting a base plate 106 having two openings through which threaded shafts 108 can pass. The base plate 106 is intended to support a plurality of counterbalance slabs 110, each having two openings through which the shafts 108 can pass. The shafts 108 are the stems of bolts 112 which pass through all of the slabs 110 and the base plate 106, and are secured in place by washers and nuts 114.

As seen in FIGS. 5A and 7, a slotted wedge bolt 116 is secured to and extends downwardly from the bottom plate 84. A wedge 120 is driven through the slot and its interaction against the underside of frame plate 119 serves to hold the assembly 14 firmly against the downstream side of the frame 10.

As illustrated in FIGS. 5A and 6, a wide U-shaped bracket 130 is welded to the plate 81, specifically spanning between the bracket portion 28 and the main body of the plate 81. The bracket 130 is adapted to span one of the portions 11 and cooperates with a wedge 134, which is driven in between the bracket 130 and the corresponding portion 11 (that to the left in FIG. 1), in order to tighten the grip of the assembly 14 on the frame, and position the assembly on the mill pass line. Attention is now directed to FIGS. 1, 5A, 6 and 8, for a more detailed description of the guide box carriage 50. As seen in FIG. 6, the guide box carriage 50 has a dovetail connection with the cross adjusting base 56. More specifically, the guide box carriage 50 has welded thereto a first trapezoidal portion 140 and is shaped to receive a second trapezoidal portion 142 which is fastened to the carriage 50 by suitable bolts 144. The cross adjusting base 56 has a dovetail portion 146 which is received between the trapezoidal portions 140 and 142 with a friction fit. The cross adjusting base 56 in turn provides a dovetail recess between a portion 148 and a portion 150, the latter being an independent element capable of being fastened to the cross adjusting base 56.

The guide box 58 shown schematically in FIG. 1 has a male dovetail portion adapted to be received and locked between the portions 148 and 150.

Figure 8:
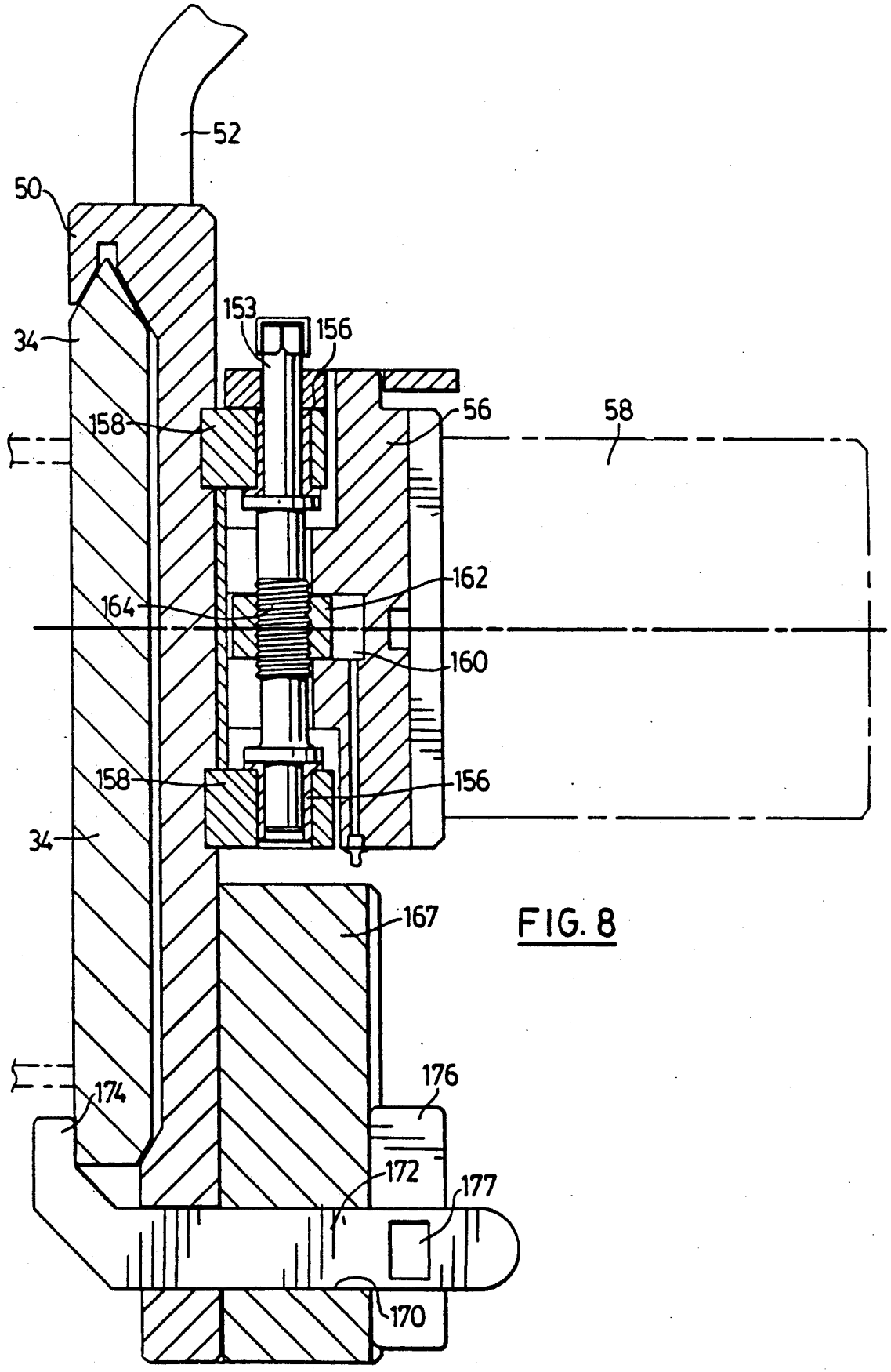
FIG. 8 is a vertical sectional view taken at the line 8—8 in FIG. 5A.

As best seen in FIG. 8, the cross-adjusting base 56 is adjustable vertically by rotating a shaft 153 which turns in stationary bearings 156 held in brackets 158 which are fixed with respect to the carriage 50. The base 56 has a recess 160 in which a non-rotating nut 162 is received. An intermediate portion 164 of the shaft 153 is threaded, and engages the nut 162. It will thus be appreciated that, as the shaft 153 is rotated, the nut 162 moves upwardly or downwardly depending on the direction of rotation, thus carrying the guide box carriage 56 with it. The force exerted through the nut 162 is great enought to overcome the friction fit between the dovetail portion 146 and the trapezoidal portions 140 and 142. Thus, when the carriage 56 reaches a desired position, it remains in place due to the friction fit.

As seen at the lower portion of FIG. 8, the guide box carriage 50 has welded thereto a portion 167, and the carriage 50 and the portion 167 have a machined opening 170 adapted to receive an captive lock element 172. The lock element 172 has an angulated inner portion 174, and a transverse opening for receiving a wedge 176. As can be seen in FIG. 8, the lock element 172 is adapted to securely hold the guide box carriage 50 in place against the slide bar 34.

The lock element 172 is captive due to the angulated portion 174 on one end, and a lug 177 which is welded or otherwise affixed adjacent the end opposite from the portion 174 (after the lock element 172 has been inserted through the opening 170).

While the carriage 50 is being handled by an overhead crane and dropped down against the slide bar 34, the lock element 172 will rest in a position approximately 180° from that shown in FIG. 8, i.e. with the angulated inner portion 174 extending substantially downwardly. Once the carriage 50 has achieved its desired position with respect to the slide bar 34, the operator rotates the lock element 172 in order to bring the angulated inner portion 174 to an upright position, in contact with the bottom of the slide bar 34. At this point the above-mentioned wedge 176 is driven into place.

In FIG. 8, the guide box itself is illustrated in broken lines at 58.

Attention is now directed to FIGS. 1, 5A and 6 for a description of the bell mouth mounting plate 66. At an intermediate portion of the plate 66 there is provided a bracket 180 which defines a lateral cross bar 182 supported between integral end portions 184 and 185, the latter two being welded to the mounting plate 66. The cross bar 182 is spaced away from the main surface of the mounting plate 66, in order to receive one leg of an L-shaped bracket 188. The other leg of the bracket 188 is visible in FIG. 1, and is integral with the bell mouth 74. Thus, if one were to view the bell mouth 74 and the bracket 188 along the pass line looking at the smaller end of the bell mouth 74, the bracket would extend rightwardly and then downwardly in an L-shape, the downward leg thereof being inserted between the cross bar 182 and the face of the mounting plate 66. When the bell mouth and bracket 188 have been put into place, a wedge 190 is driven in to secure the bell mouth in its resting position. The bell mouth 74 is manually removable to allow visual alignment of the guide box 58 and the mill rolls.

The mounting plate 66 itself is held in position against the slide bar 34 by the use of a separate locking element which is essentially the same as the element 172 shown in FIG. 8. Looking at FIG. 5A, the locking element is shown at 193, and the corresponding wedge at 194.

The furthest downstream position of the carriage 50 is determined by the position of an abutment bolt 196 in threaded engagement with a bracket 198 secured (as by welding) to the slide bar 34 (see FIGS. 1 and 5A).

Figure 9:
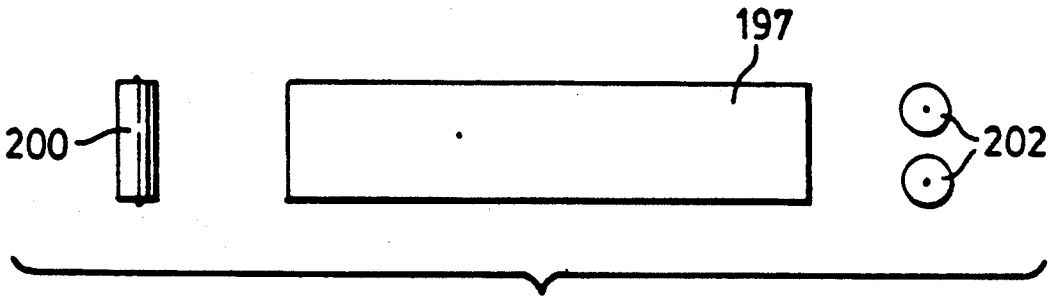
FIG. 9 is a schematic plan view of a portion of a processing line.

Attention is now directed to FIG. 9, included for clarification. This figure is a schematic plan view of a portion of a processing line, including an uplooper 197, a set of horizontal mill rolls 200 immediately upstream of the uplooper 197, and a set of vertical mill rolls 202 immediately downstream of the uplooper 197. The direction of travel of the product is from left to right in FIG. 9. It is to be understood that the sets of mill rolls shown in this figure are only two of a large number of sequential roll stands, and that neither of the illustrated sets of rolls is necessarily at the beginning or at the end of the complete sequence.

It will thus be appreciated that the foregoing invention provides an easily installed, easily operated and easily removed apparatus consisting essentially of three main portions, each of which can be installed and removed by the use of an overhead crane, with a manually removale bell mouth, the apparatus being attached to and suspended by an existing frame or uplooper. The apparatus is independent of the closest mill roll stand, and can be quickly removed out of the way to allow adjustment or replacement of that stand. As has been explained, various alignments can be made during installation.

It will further be understood that this invention is not limited to entry roller guides, and may be adapted to all entry guides and delivery guides.

While one embodiment of this invention has been illustrated both schematically and in greater detail in the accompanying drawings, and described hereinabove, it will be evident to those skilled in the art that changes and modifications may be made thereto without departing from the essence of this invention, as set forth in the appended claims.

The embodiments of the invention in which an exclusive property or privilege is claimed are defined as follows:

1. In a hot rolling assembly for rolling a metal billet into a desired cross-section, the assembly including a plurality of roll stands and a frame means upstream of one of the roll stands, the improvement which comprises:

an entry guide mounting assembly removably mounted to the frame means between the latter and said one of the roll stands, a slide bar fixed to and supported by the entry guide mounting assembly, the slide bar extending substantially parallel with the pass line but spaced laterally therefrom, a guide box carriage removably secured to said slide bar, a guide box supported by said guide box carriage, the guide box being on the pass line.

a bell mouth carriage removably secured to said slide bar between the guide box carriage and the frame means, a bell mouth assembly removably secured to said bell mouth carriage, the bell mouth assembly being on the pass line, the slide bar being a vertically oriented plate with a horizontal upper edge defining substantially a point in cross-section, and a horizontal bottom edge, each said carriage having a pointed groove complementary with said point, and also having gripping means for securely gripping the bottom of the said slide bar so as to firmly mount the respective carriage to the slide bar.

2. The invention claimed in claim 1, in which the slide bar has a substantially horizontal upper edge, and in which each said carriage has a hook means adapted to engage said upper edge, thus allowing each carriage to be installed on and removed from the slide bar through vertical movement with the aid of an overhead crane, and to be slid longitudinally along the slide bar to a desired final position each carriage further having securement means by which it can be fixed in place on the slide bar.

3. The invention claimed in claim 1, which further includes vertical adjustment means by which the guide box can be adjusted vertically with respect to the guide box carriage while the hot rolling assembly is operating, whereby the guide box can be aligned with the pass line.

4. The invention claimed in claim 1, in which the frame means is the downstream end of an uplooper frame.

5. The invention claimed in claim 4, which further includes vertical adjustment means by which the guide box can be adjusted vertically with respect to the guide box carriage while the hot rolling assembly is operating, whereby the guide box can be aligned with the pass line.

6. The invention claimed in claim 1, in which the entry guide mounting assembly includes freely rotating rollers on opposite sides of the in-process product, at least one of said rollers being adjustable toward and away from the in-process product.

7. The invention claimed in claim 1, in which each carriage is a substantially rectangular steel plate.

8. The invention claimed in claim 6, in which, each carriage is a substantially rectangular steel plate.

* * * * *